United States Patent [19]

Jönsson et al.

[11] Patent Number: 4,848,451

[45] Date of Patent: Jul. 18, 1989

[54] PLATE HEAT EXCHANGER

[75] Inventors: Nils-Ake Jönsson, Staffanstorp; Bo Göran Nilsson, Kävlinge; Hans-Lennart Persson, S. Sandby, all of Sweden

[73] Assignee: Alfa-Laval Thermal AB, Tumba, Sweden

[21] Appl. No.: 193,280

[22] PCT Filed: Jan. 9, 1987

[86] PCT No.: PCT/SE87/00006

§ 371 Date: Apr. 21, 1988

§ 102(e) Date: Apr. 21, 1988

[87] PCT Pub. No.: WO87/04234

PCT Pub. Date: Jul. 26, 1987

[30] Foreign Application Priority Data

Jan. 13, 1986 [SE] Sweden ..... 8600127

[51] Int. Cl.[4] ..... F28F 3/08

[52] U.S. Cl. ..... 165/167; 165/164; 165/166; 277/206 R

[58] Field of Search ..... 165/167, 166, 164; 277/206 R

[56] References Cited

U.S. PATENT DOCUMENTS

| | | | |
|---|---|---|---|
| 2,203,123 | 6/1940 | Astle | 165/167 |
| 4,432,415 | 2/1984 | Wright | 165/167 X |
| 4,586,562 | 5/1986 | Carlson et al. | 165/167 X |
| 4,595,208 | 6/1986 | Jönsson et al. | 165/167 X |

FOREIGN PATENT DOCUMENTS

| | | | |
|---|---|---|---|
| 113884 | 10/1941 | Australia | 165/167 |
| 2112168 | 10/1971 | Fed. Rep. of Germany . | |
| 2357059 | 5/1975 | Fed. Rep. of Germany . | |
| 84/00060 | 1/1984 | PCT Int'l Appl. . | |
| 84/01209 | 3/1984 | PCT Int'l Appl. . | |
| 84/03555 | 9/1984 | PCT Int'l Appl. . | |
| 368455 | 7/1974 | Sweden . | |
| 1041805 | 9/1966 | United Kingdom . | |
| 2000267 | 1/1979 | United Kingdom . | |

*Primary Examiner*—Larry Jones

*Attorney, Agent, or Firm*—Davis Hoxie Faithfull & Hapgood

[57] ABSTRACT

The present invention relates to a plate heat exchanger comprising heat exchange plates clamped between a frame plate and a pressure plate, the frame plate and the pressure plate having ports with linings for intake and outflow of media to be heat exchanged and the heat exchange plates having ports in alignment with corresponding ports in the frame plate and the pressure plate round which ports of the heat exchange plates ring gasket grooves extend. According to the invention the one of the frame plate or the pressure plate (1) facing the rear side of the ring gasket groove (4) of the heat exchange plates is provided with linings (2; 14; 22; 23) which do not require machining of the plate (1) at the area of the ports and that the sealing between the lining (2; 14; 22; 23) and a heat exchange plate (3) is brought about by means of a ring gasket (10; 21) engaging the ring gasket groove of the heat exchange plate (3) positioned closest to the frame plate or the pressure plate (1).

9 Claims, 5 Drawing Sheets

PLATE HEAT EXCHANGER

Figure 1:
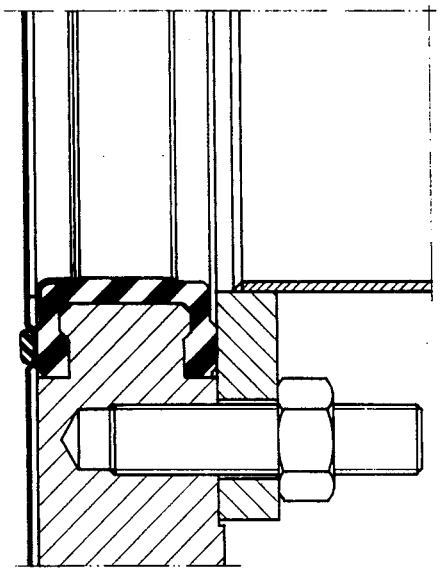

This invention relates to a plate heat exchanger comprising heat exchange plates mounted between a frame plate and a pressure plate, the frame plate and the pressure plate having ports lined with linings for intake and outtake of media that shall be heat exchanged, and the heat exchange plates having ports in alignment with corresponding ports in the frame plate and the pressure plate round which ports of the heat exchange plates there extend ring gasket grooves, each ring gasket groove having a rear side and a front side, the front side of the groove being that one where the ring gasket is intended to be placed.

A plate heat exchanger, normally seen, comprises a frame plate, a pressure plate and between these ones heat exchange plates all of which are mounted in a frame. The heat exchange plates and, as a rule, also the frame plate and the pressure plate are provided with openings in their corners which function as ports for intake and outtake of the media that are to be heat exchanged. In this connecton the frame plate and the pressure plate, as a rule, have been provided with special linings in the ports for being able to resist corrosive media.

In the applicant's own international publications WO 84/00060 and WO 84/01209 are shown linings for the ports in a frame plate or a pressure plate of a plate heat exchanger which linings have such a design that machining of the frame plate or the pressure plate at the area of the ports does not need to be made. If accordingly the ports in a frame plate are provided with linings according to some one of the mentioned patent publications, the plate package shall be so arranged in the heat exchanger that the face of the plates being provided with gaskets is directed to the frame plate. This means that the heat exchange plate being closest to the pressure plate has its rear side directed to the pressure plate.

In order to solve the problem with the sealing between the pressure plate and the closest heat exchange plate it has previously been necessary to machine the pressure plate at the areas of its ports, whereafter the ports have been provided with a thick lining of rubber, metal or the like, which lining has been provided with a shoulder for sealing against the rear side of the ring gasket groove of the heat exchange plate. This sealing method is apparent from FIG. 1.

The great drawback with this method is that the machining of the pressure plate has partly been very expensive, partly required special machining tools, alternatively advanced working machines.

Therefore, there has been a desire to solve the mentioned sealing problem without needing to machine the pressure plate. This desire has been accentuated lately by the presence in the market of the inventions described in the two above-mentioned publications which as has been mentioned disclose solutions for lining the ports in a frame plate or a pressure plate without machining of the plate at the area of the ports. In this connection it ought to be said that if the linings according to WO 84/00060 or WO 84/01209 should be inserted into the ports in a pressure plate, the sealing problems would instead arise between the frame plate and the adjacent heat exchange plate depending on the fact that the rear side of the gasket groove of the heat exchange plate would be directed towards the frame plate. Thus, the present invention is suitable to use in either a frame plate or a pressure plate depending on how the heat exchange plates are directed in the plate heat exchanger.

This invention intends to solve the problems described above. This has been made possible by a plate heat exchanger of the kind mentioned by way of introduction, having the characterizing features mentioned in the claims.

Figure 9:
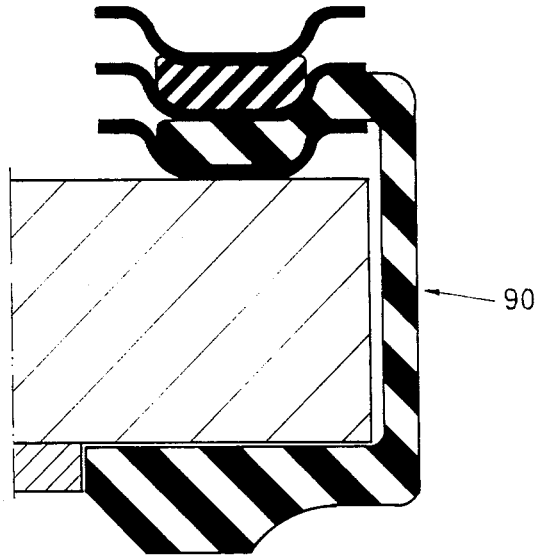
Figure 10:
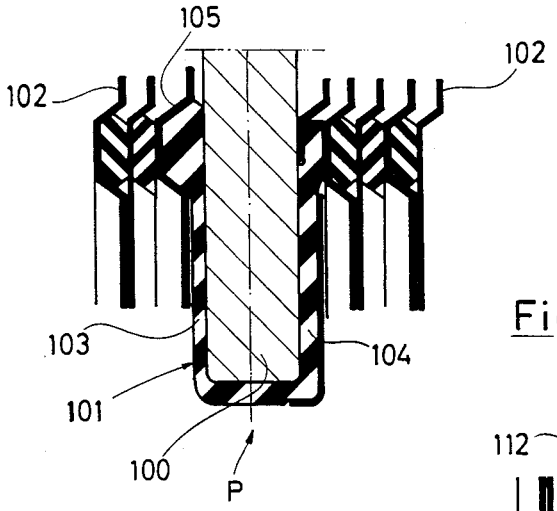
Figure 11:
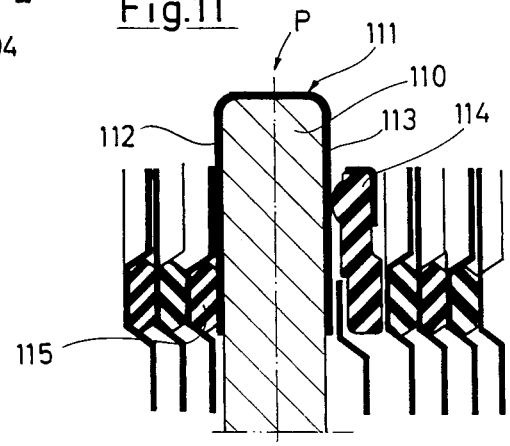
Figure 12:
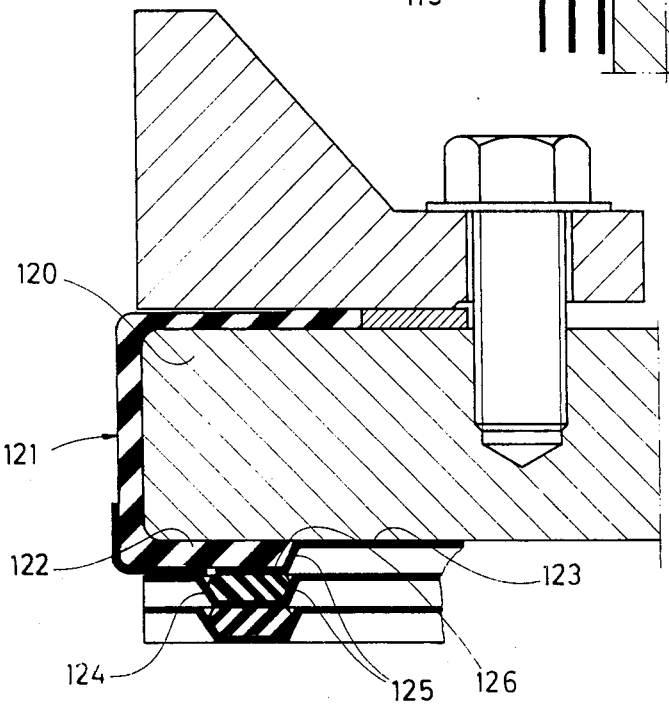

The invention shall be described more closely in connection with the accompanying drawings, in which FIG. 1 shows known technique and FIGS. 2–9 show different embodiments of the invention, FIGS. 10, 11 show two embodiments regarding the lining of ports in a separation plate inside a plate heat exchanger and FIG. 12 shows a lining of a port in a frame plate or a pressure plate towards which the front side of the gasket groove of a heat exchange plate is directed.

Figure 2:
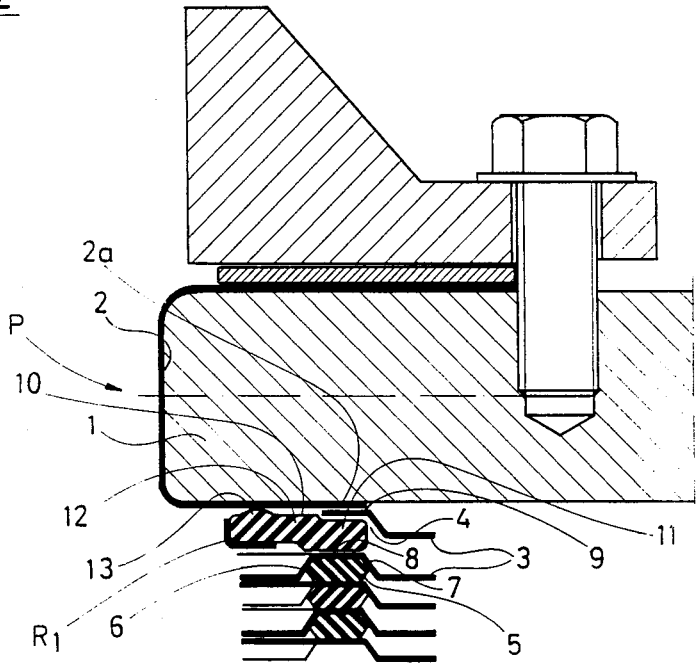

Referring to FIG. 2 there is shown there a frame plate or a pressure plate 1 being provided with a metal lining 2 in one of its ports. The port is indicated by a P in the figure. Furthermore, the figure discloses heat exchange plates 3 having its sealing side directed from the frame plate or the pressure plate 1. In this connection each heat exchange plate 3 has a ring gasket groove 4 provided with a ring gasket 5. The ring gasket groove 4 has a rear side 9 which is accordingly directed towards the frame plate or the pressure plate 1. Each ring gasket groove 4 has a cross-section comprising two oblique flanks 6, 7 and an intermediate plane portion 8.

When mounting the plate heat exchanger, the closest heat exchange plate would rest with the rear side 9 of the ring gasket groove against the one flange 2*a* of the metal lining 2. This would mean that the sealing between the heat exchange plate and the metal lining would not be sufficient. This invention has solved that problem in the following way.

An annular portion of the heat exchange plate closest to the frame plate or the pressure plate is cut away at the area of the ports. In this connection a so big part has been cut away that also one 6 of the flanks in the ring gasket groove has been removed. The portion taken away from the heat exchange plate is replaced by an annular elastic gasket 10, preferably made of rubber. The gasket 10 comprises a plane portion 11 intended to rest and be fastened by means of for instance glueing against the plane portion 8 of the ring gasket groove 4 of the plate 3. This plane portion 11 constitutes the sealing means between the two heat exchange plates lying closest to the frame plate or the pressure plate. Furthermore, the gasket 10 comprises an additional plane portion 12 radially inside the plane portion 11, which portion 12 is provided with a projection 13. This projection 13 constitutes the real sealing between the frame plate or the pressure plate and the adjacent heat exchange plate. In this connection the plane portion 12 is lying on a level axially closer to the frame plate or the pressure plate 1 than the level of the plane portion 11. Furthermore, the rubber part 12 can be provided with an annular plate $R_1$ which partly encloses the rubber part, partly equalizes the load from the adjacent heat exchange plate.

Figure 3:
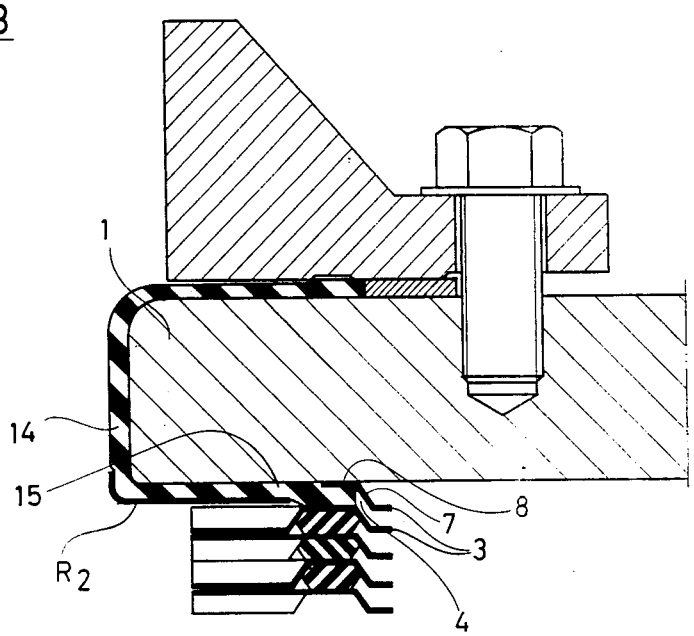

In FIG. 3 there is shown a frame plate or a pressure plate 1 provided with a rubber lining 14 in its ports. In this connection one 15 of the flanges of the lining partly functions as a gasket between the two heat exchange plates lying closest to the frame plate or the pressure plate 1, partly as a gasket between this said plate and the adjacent heat exchange plate. In order that the last mentioned sealing task shall be solved, the heat exchange plate lying closest to the frame plate or the pressure plate must be machined in the same way as in the embodiment according to FIG. 2. In order that the contact between the rubber flange 15 and the plane surface 8 in the ring gasket groove 4 of the heat exchange plate 3 shall be as good as possible, a recess has been made in the rubber flange 15 adapted for the plane portion 8 of the heat exchange plate 3. In this connection the outer portion of the rubber flange 15 rests against the plane portion 8 of the ring gasket groove of the plate and the end surface of the rubber flange extends essentially right up to the oblique flank 7 of the ring gasket groove 4. Due to that fact the outer portion of the rubber flange functions as a ring gasket between the two heat exchange plates closest to the frame plate or the pressure plate.

The rubber flange 15, as is shown in the figure, can be provided with an annular plate $R_2$ having a radial extension from the port and outwards and having the same function as the abovementioned plate $R_1$.

Figure 4:
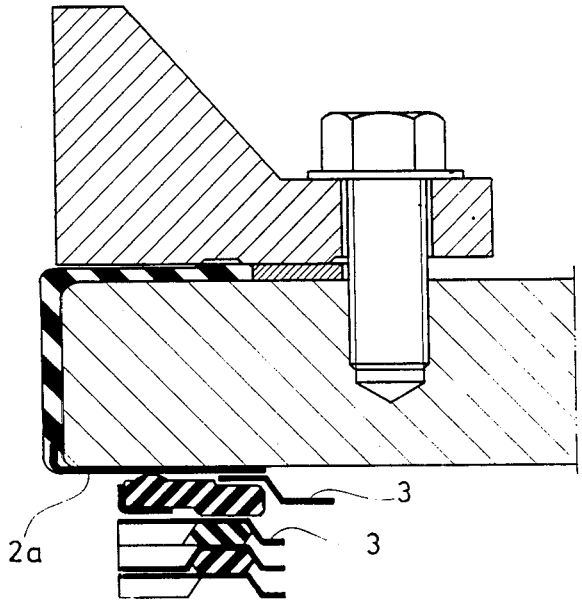
Figure 5:
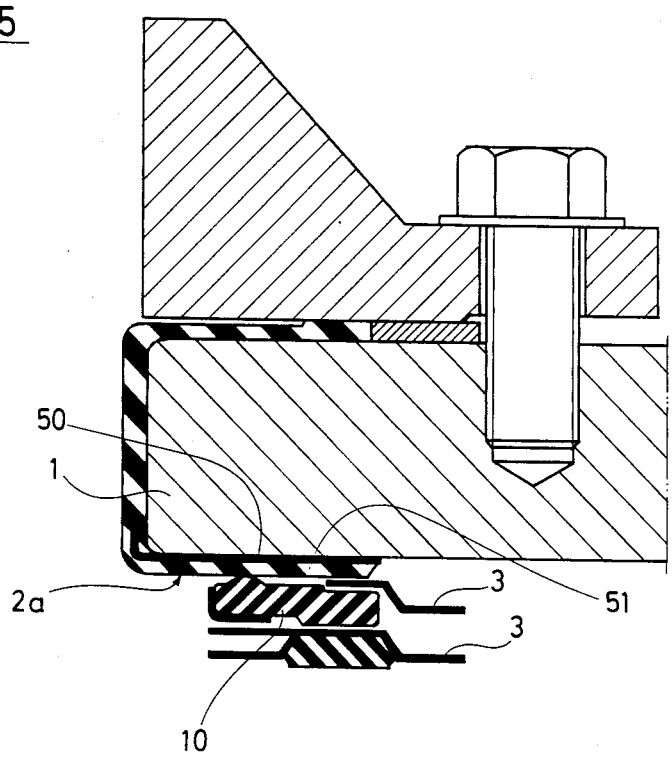

FIGS. 4 and 5 disclose embodiments having great similarities with that one according to FIG. 2. The difference is that the lining is made of both a metallic and a non-metallic material. Thus, in FIG. 4 at least that flange 2*a* that is intended to rest against a heat exchange plate 3 is made of the metallic material. The sealing between the flange and the heat exchange plate is done in the same way as in the embodiment according to FIG. 2.

According to FIG. 4 is essentially all that part of the lining going through the port made of the non-metallic material.

Of course, it is within the scope of the invention to change this state of things so that instead this part of the lining is made of the metallic material.

According to FIG. 5 the flange 2*a* comprises a metallic portion 50 and a non-metallic portion 51, which latter portion is an integral part of the remaining part of the lining, preferably made of rubber. As is apparent from the figure, the metallic portion 50 rests against the frame plate or the pressure plate 1 while the non-metallic portion 51 is applied onto the outside of the metallic portion and, accordingly, is in contact with the gasket 10 and the heat exchange plate 3.

Figure 6:
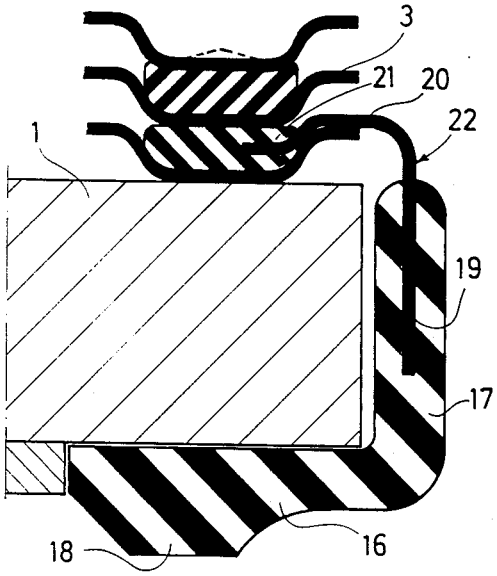

In FIG. 6 there is shown a fifth embodiment of the invention. According to this embodiment the lining 22 of the frame plate or the pressure plate 1 comprises an elastic part having a flange 16 and a cylindrical portion 17. In this connection the flange 16 is provided with a shoulder 18 intended to rest against a not shown connecting tube flange. The elastic part of the lining cooperates with a metallic part comprising a cylindrical portion 19 and a flange 20. This flange 20 is made in one piece with a ring gasket 21 intended to be applied into the ring gasket groove of the heat exchange plate lying closest to the frame plate or the pressure plate. Thus, this ring gasket 21 functions as a gasket between the two heat exchange plates being applied closest to the frame plate or the pressure plate.

As is apparent from the figure, the heat exchange plate closest to the frame plate or the pressure plate will rest directly against the said plate but, in this case, it does not matter because there will be no sealing between the frame plate or the pressure plate and the adjacent heat exchange plate. The reason why is that the lining has an axial extension to the area between the first two heat exchange plates counted from the frame plate or the pressure plate.

Figure 7:
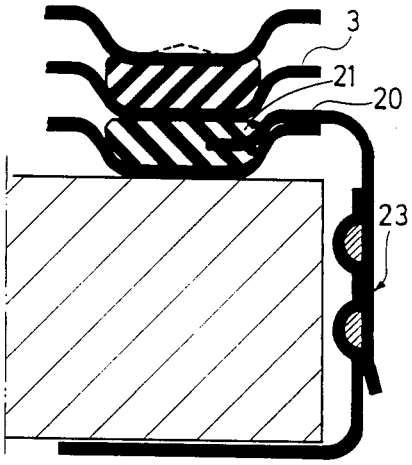
Figure 8:
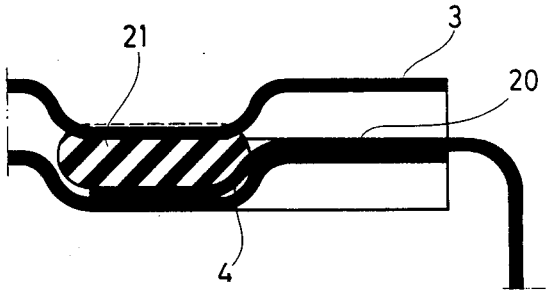

The embodiment according to FIG. 7 differs from that according to FIG. 6 only in that respect that the whole lining 23 is made of a metallic material. In order to solve the problem with the insertion of lining into the port, the lining is divided into two parts, the two cylindrical portions of the lining being fastened to each other in a suitable way, for instance by welding.

As has been shown in FIGS. 6 and 7 the flange 20 is made in one piece with the ring gasket 21. However, it is not necessary to do so which is shown in the embodiment according to FIG. 8. According to this embodiment the flange 20 has such a design that it rests against the plate 3 in such a way that it follows the contour of the ring gasket groove 4 of the heat exchange plate 3. When mounting the heat exchange plates in the heat exchanger a ring gasket 21 is placed between the two adjacent heat exchange plates, whereby these two plates are sealed off from each other. An advantage with this solution is that if the mentioned ring gasket needs to be exchanged, the old gasket can be easily taken away and a new one be inserted.

In FIG. 9 there is shown an embodiment different from that according to FIG. 6 only in that respect that the whole lining 90 is made of a non-metallic material, preferably rubber.

In the text has been mentioned that the elastic, non-metallic material can be composed of rubber. The invention is, of course, not limited to that but other elastomers like plastic can, of course, be possible. The metallic material can be composed of stainless steel, titanium, hastalloy or other metals.

For certain heat exchange tasks a separation plate is sometimes used for changing the flow of the medium. The separation plate is located inside the plate package which makes it possible for the media to pass through the separation plate. Therefore, there are the same demands regarding the corrosion resistance upon the connections of the separation plate as upon the connections of the frame plate and the pressure plate. Thus, also the separation plate has previously had to be machined if linings have been inserted into the ports of the same.

The technique shown in this patent application and in the mentioned international publications WO 84/00060 and WO 84/01209 can also be applied upon the separation plate. Examples on that are the apparatuses according to FIGS. 10 and 11.

Referring to FIG. 10 there is shown there a separation plate 100 provided with a lining 101 of a non-metallic material for protecting the plate at the port P. Heat exchange plates 102 are arranged on both sides of the separation plate, the plates on the right side of the separation plate having the ring gasket grooves directed from the same while the plates on the left side of the separation plate have the gasket grooves directed towards the same.

The lining 101, made of an elastic, non-metallic material, preferably rubber, has two flanges 103, 104. In this connection the flange 104 on the right side of the separation plate co-operates with the heat exchange plates in the same way as is shown in FIG. 3 while the flange 103 on the left side of the separation plate is provided with an integrated ring gasket 105 intended to fit in the ring gasket groove of the adjacent heat exchange plate in the same way as is shown in WO 84/01209.

In FIG. 11 there is shown a separation plate 110 provided with a lining 111 of metallic material for lining of the port P. The metal lining comprises two flanges 112, 113, the flange 113 on the right side of the separation plate co-operating with the adjacent heat exchange plate via a ring gasket 114 in the same way as is shown in FIGS. 2 and 4 while the flange 112 on the left side of the separation plate co-operates with the adjacent heat exchange plate via a ring gasket 115 in its ring gasket groove.

Even if only two embodiments of the separation plate have been described above, it ought to be made clear that all solutions shown in FIGS. 2–9 can be possible to use in the separation plate.

In FIG. 12 there is shown a lining to be applied onto that one of the frame plate or the pressure plate facing the gasket groove of the heat exchange plates. Thus, the figure shows a frame plate or a pressure plate 120 provided with a rubber lining 121 at one of its ports. In this connection one 122 of the flanges functions as a gasket between the frame plate or the pressure plate 120 and the adjacent heat exchange plate 123. The heat exchange plate has a ring gasket groove with a cross-section comprising two flanks 124, 125 and an intermediate plane portion 126. In order that the mentioned sealing task shall be solved, the heat exchange plate must be machined in a particular way. Thus, an annular part of the heat exchange plate is cut away at the area of the ports. In this connection such a great portion has been taken away that also that one 124 of the two flanks of the ring gasket groove, positioned closest to the port, is removed. The outer part of the rubber flange 122 rests against the plane portion 126 of the ring gasket groove of the plate 123, the end surface of the rubber flange 122 extending essentially right up to the oblique flank 125 of the ring gasket groove. Due to that fact the rubber flange 122 functions as a ring gasket between the frame plate or the pressure plate 120 and the adjacent heat exchange plate 123.

Of course, it is within the scope of the invention to make the lining 121 in FIG. 12 of one metallic part and one non-metallic part. In this connection that part of the lining that is to cooperate with the heat exchange plates, shall be made of non-metallic material.

What is claimed:

1. A plate heat exchanger comprising heat exchange plates interposed between a frame plate and a pressure plate with their front sides turned in one direction and their rear sides turned in the opposite direction, the frame plate and/or the pressure plate having ports with linings, which do not require machining of the plates at their port areas, and the heat exchange plates having corresponding ports in alignment with said ports in the frame plate and/or the pressure plate and ring gasket grooves extending around the respective ports in the front sides of the heat exchange plates, characterized in that the sealing between each lining (2; 14; 22; 23), that is provided in the frame plate or the pressure plate (1) facing the rear sides of the heat exchange plates, and the heat exchange plate (3) positioned closest to the frame plate or the pressure plate (1) is accomplished by means of a ring gasket (10;21) located in the ring gasket groove on the front side of said heat exchange plate and sealingly engaging said lining (2; 14; 22; 23).

2. A plate heat exchanger according to claim 1, wherein each lining has two flanges and each ring gasket groove of the heat exchange plates has a cross-section with two flanks and an intermediate plane portion, characterized in that a part of the heat exchange plate (3) positioned closest to the frame plate or the pressure plate (1), including one flank (6) of each ring gasket groove (4), is cut away at the area of the port, and that each ring gasket (10) comprises one portion (11) sealingly clamped between the plane portion (8) of the ring gasket groove (4) of the said heat exchange plate and the rear side of the bottom surface of the ring gasket groove of the next heat exchange plate, and another portion (12, 13) sealingly rests against one of said flanges of the lining (2).

3. A plate heat exchanger according to claim 1, wherein each lining is made of a non-metallic material and each ring gasket groove of the heat exchange plates has a cross-section with two flanks and an intermediate plane portion, characterized in that a part of the heat exchange plate (3) positioned closest to the frame plate or the pressure plate (1), including one flank (6) of each ring gasket groove (4), is cut away at the area of the port, and that said ring gasket constitutes an integral part of one flange (15) of the lining (14).

4. A plate heat exchanger according to claim 2, characterized in that each lining comprises a metallic and a non-metallic part, the latter part forming said one of said flanges.

5. A plate heat exchanger according to claim 1, characterized in that said lining (22; 23) comprises a metallic part (20) fastened to said ring gasket (21).

6. A plate heat exchanger according to claim 5, characterized in that the remaining part (16, 17) of the lining (22) is non-metallic.

7. A plate heat exchanger according to claim 1, characterized in that said lining comprises a metallic part with a flange-like portion (20) following the contour of the ring gasket groove (4) of the heat exchange plate positioned closest to the frame plate or the pressure plate, the ring gasket (21) being situated in the ring gasket groove (4) on the top of said portion (20).

8. A plate heat exchanger comprising heat exchange plates interposed between a frame plate and a pressure plate with their front sides turned in one direction and their rear sides turned in the opposite direction, and at least one separation plate provided with ports and arranged inside the heat exchanger between two adjacent heat exchange plates, the heat exchange plates having corresponding ports in alignment with said ports in the separation plate and ring gasket grooves extending around each port in the front sides of the heat exchange plates, characterized in that the separation plate (100) has a lining (101) of non-metallic material, which lining does not require machining of the plate (100) at the port areas, and that the lining (101) has two flanges (103, 104), one of the flanges (104) being arranged on the side of the separation plate facing the rear sides of the heat exchange plates and having an outer portion located in the ring gasket groove on the front side of a modified heat exchange plate positioned closest to the separation plate (100), and the other flange (103) being arranged on the other side of the separation plate facing the front sides of the heat exchange plates and being provided with an integrated ring gasket (105) positioned in the ring gasket groove of the heat exchange plate positioned closest to said other side of the separation plate.

9. A plate heat exchanger comprising heat exchange plates interposed between a frame plate and a pressure plate with their front sides turned in one direction and their rear sides turned in the opposite direction, and at least one separation plate provided with ports and arranged inside the heat exchanger between two adjacent heat exchange plates, the heat exchange plates having corresponding ports in alignment with said ports in the separation plate and ring gasket grooves extending around each port in the front sides of the heat exchange plates, characterized in that the separation plate (110) has a lining (111) of metallic material, which lining does not require machining of the plate (110) at the port areas, and that the lining (111) has two flanges (112, 113), one of the flanges (113) being arranged on the side of the separation plate facing the rear sides of the heat exchange plates and cooperates with a ring gasket (114), one part of which is located in the ring gasket groove on the front side of a modified heat exchange plate positioned closest to the separation plate (110) and another part of which rests against one of said flanges, and the other flange (112) being arranged on the other side of the separation plate (110) facing the front sides of the heat exchange plates and co-operating with the heat exchange plate positioned closest to said other side of the separation plate via a ring gasket (115) in the ring gasket groove of the heat exchange plate.

* * * * *